US009540773B1

(12) United States Patent
Pratt

(10) Patent No.: US 9,540,773 B1
(45) Date of Patent: Jan. 10, 2017

(54) RAIL ROLLING APPARATUS AND METHOD OF USE

(71) Applicant: John W. Pratt, Red Bud, IL (US)

(72) Inventor: John W. Pratt, Red Bud, IL (US)

( * ) Notice: Subject to any disclaimer, the term of this patent is extended or adjusted under 35 U.S.C. 154(b) by 217 days.

(21) Appl. No.: 14/539,783

(22) Filed: Nov. 12, 2014

(51) Int. Cl.
*E01B 29/00* (2006.01)
*E01B 33/02* (2006.01)
*E01B 31/02* (2006.01)
*E01B 31/08* (2006.01)

(52) U.S. Cl.
CPC ..... *E01B 29/00* (2013.01); *E01B 31/02* (2013.01); *E01B 31/08* (2013.01); *E01B 33/02* (2013.01)

(58) Field of Classification Search
CPC ..... E01B 29/22; E01B 29/16; E01B 29/26; E01B 29/00; E01B 29/04; E01B 31/02; E01B 31/08; E01B 31/18; E01B 33/02; E01B 33/00; B25B 27/00; B25B 33/00; Y10T 29/53896; Y10T 29/53943; B66F 15/00
USPC ..... D8/14, 16, 88, 89; 254/121, 131, 25; 104/7.1, 2, 4, 8; 29/267, 278; 248/311.3; 294/12
See application file for complete search history.

(56) References Cited

U.S. PATENT DOCUMENTS 514,893 A 2/1894 Anderson
2,712,433 A 7/1955 Holt
2,926,616 A * 3/1960 Talboys ..... E01B 33/02 104/7.2
3,192,871 A 7/1965 Krause, Jr.
3,417,708 A * 12/1968 Sauterel ..... E01B 27/17 104/8
3,635,164 A 1/1972 Patton
3,952,665 A * 4/1976 Stewart ..... E01B 33/02 104/8
4,392,433 A 7/1983 Nyland
4,399,753 A * 8/1983 Theurer ..... E01B 27/17 104/7.2
4,703,968 A * 11/1987 LaBounty ..... B66C 1/64 294/106
4,800,817 A 1/1989 Carstensen et al.
4,903,608 A * 2/1990 Theurer ..... E01B 27/17 104/12
5,127,567 A * 7/1992 LaBounty ..... B23D 17/06 225/103
5,295,440 A 3/1994 Cleveland
5,297,482 A 3/1994 Cleveland
6,089,163 A * 7/2000 Williams ..... E01B 35/02 104/2
7,089,867 B2 8/2006 Nilsen
7,287,476 B2 10/2007 Durbano
8,371,225 B2 2/2013 Bointon et al.
2011/0271866 A1 11/2011 Juneau

* cited by examiner

*Primary Examiner* — Mark Le
(74) *Attorney, Agent, or Firm* — Kevin L. Klug

(57) ABSTRACT

A rail rolling apparatus and method of use, the apparatus having a back end portion with one or more apertures, a middle portion, and one or more hooks which are capable of substantially receiving the base of a railroad rail. The apertures are sized to receive one or more backhoe bucket teeth. When positioned with the railroad rail and the backhoe bucket, the method of use allows the backhoe bucket to repair or fix rolled over rail and bent rail, and further allows for positioning or lining of track via various movements of the bucket or backhoe arm.

4 Claims, 26 Drawing Sheets

RAIL ROLLING APPARATUS AND METHOD OF USE

This application claims priority of U.S. Provisional Patent Application No. 61/907,885, filed Nov. 22, 2013, entitled Rail Rolling Apparatus and Method of Use.

BACKGROUND OF THE INVENTION

The art of the present invention relates to the railroad construction and maintenance fields in general and more specifically to apparatuses and devices within those fields that assist an employee or contractor with new track construction, track maintenance, track rehabilitation, and track salvage operations.

Modern railroad track typically uses rails made of hot rolled steel with a profile of an asymmetrical rounded I-beam. Known as flat bottom rail or T-section rail, it is the dominant rail in worldwide use today. The rail has a top or head portion, a middle or web portion, and a foot or base portion which can rest directly on the railroad tie or the corresponding plate. When the rail is installed, the base portion is generally angled in relation to a horizontal plane and this angle is known as the base angle. Most typical rail sections or 'sticks' are approximately 39 feet long unless its continuous welded rail (CWR), in which case, each rail or 'stick' can be 500-600 feet long and welded to another rail or 'stick'.

For numerous reasons, track rail sections must be routinely moved and positioned or repositioned in relation to other rail sections or in relation to the cross-ties such that the rail profile is maintained thereby considerably enhancing rail service life. Also, one of the most common causes of railroad accidents or derailments is rail roll-over. The forces generated between the moving train wheel and the rail can be resolved into two components, a lateral force (L) and a vertical force (V). If the moment generated by the lateral force (L) is greater than the moment generated by the vertical force (V), the rail can rotate about its corner or roll-over.

When a rail has rolled-over, especially in a derailment scenario, the traditional repair procedure is for a group of workers, commonly known as a "rail gang" to slide a chain under the foot or base portion of the rail and hook one end of the chain onto the high side of the rolled rail at the foot or base portion of the rail. The other end of the chain is then wrapped around a cribbing bucket attached to a backhoe and rolled or pulled by the cribbing bucket back away from the rail and towards the backhoe. This tightens the chain and rolls the rail back down into or onto one or more steel plates in order that the rail may be re-attached to the cross-tie using one or more railroad spikes. The one or more steel plates in conjunction with the spikes hold the rail to the cross-ties. This traditional repair procedure, utilizing a chain, cannot be used to reposition or set bent rail back into the one or more plates where it could be re-attached using one or more spikes. Additionally, the chain used in this traditional repair procedure can and does periodically break creating a dangerous safety concern.

The present art rail rolling apparatus and method of use allows rolling, repositioning, and setting of rails without the deleterious effects of the prior art. The apparatus generally comprises a back-end portion, a middle portion, and one or more hooks. The back-end portion is capable of receiving a removable attachment, such as a cribbing or other type of bucket or implement of a typical piece of mechanized earth moving equipment such as a backhoe. The one or more hooks are capable of receiving a base portion of a railroad track rail. The present art rail rolling apparatus improves upon and replaces the prior art chain for rail roll-over and repair and eliminates the safety concerns related to breaking chains. The present art also allows for productivity increases since using the present art rail rolling apparatus is much faster than using chains to roll or reposition a rail. Additionally, the present art rail rolling apparatus and its method of use is capable of setting bent rail back in position into the one or more plates. As discussed, the prior art repair procedures which utilize chains does not allow the bent rail to be precisely rolled back into the one or more plates. Also, the present art rail rolling apparatus and method of use is capable of lining track without the requirement of touching the rail with the cribbing bucket. That is, contacting the rail with the cribbing bucket, as is typical with the prior art track lining method, can cause chips and cracks in the rail which could cause track failure and/or train derailment.

Accordingly, it is an object of the present invention to provide a rail rolling apparatus and method of use which allows for the safe repair of a rolled-over rail, the safe repair of a bent rolled over rail, and the safe movement of a rail section, such as when lining track.

Another object of the present invention is to provide a rail rolling apparatus and method of use which is capable of repairing rolled-over rail more quickly than with traditional apparatuses and techniques and therefore significantly increasing productivity and reducing costs for railroad service crews.

A further object of the present invention is to provide a rail rolling apparatus and method of use which is capable of repairing bent rolled-over rail without the replacement of the bent rail sections as is typically required with the traditional means.

A yet further object of the present invention is to provide a rail rolling apparatus and method of use capable of also lining track without having to touch the top or head of the rail with the bucket of the backhoe thereby eliminating any potential damage to the rail.

SUMMARY OF THE INVENTION

In accordance with the present invention, the preferred and alternate embodiments represent a rail rolling apparatus and method of use in combination with traditional mechanized earth moving equipment utilizing hydraulic, electric, pneumatic, or mechanical attachments with one or more teeth or other protrusions. For example, a backhoe with a cribbing bucket attachment having one or more teeth, such as commonly used in the railroad service industry.

The present art rail rolling apparatus generally comprises a back-end portion, a middle portion, and one or more hooks. Preferably, the one or more hooks are elevated at an approximately 20 degree angle relative to the middle portion and are capable of receiving a base portion of a railroad track rail. Alternative hook angles include any hook angle that is capable of receiving the base portion of the rail. The back-end portion is preferably elevated at an approximate 40 degree angle relative to the middle portion and further has one or more apertures capable of receiving one or more teeth or protrusions of a cribbing bucket or other attachment utilized with a backhoe or other mechanized equipment. Alternative back-end portion angles include any angle that is capable of receiving a cribbing bucket or other attachment.

The method of use for repairing or fixing a rolled-over rail, first positions the apparatus under the rail. Next, the one or more hooks are placed over the base portion of the rail.

For a rolled-over rail situation, the backhoe places the one or more teeth of the bucket into the one or more apertures from the top and tilts or rolls the cribbing bucket towards the backhoe and away from the rail. This tilting or rolling motion of the cribbing bucket causes a portion of the cribbing bucket to contact the top or head of the rail, thereby creating a fulcrum or pivot point 37. Further rolling or tilting of the cribbing bucket allows the rolled-over rail to be rolled back.

The method of use for repairing or fixing a bent rail allows the additional step of pushing or pulling on the rail with the backhoe, depending on how it is bent. The method of use for lining track allows hooking onto a piece of rail at a balance point and then sliding the rail back and forth.

DETAILED DESCRIPTION OF THE INVENTION

Figure 1:
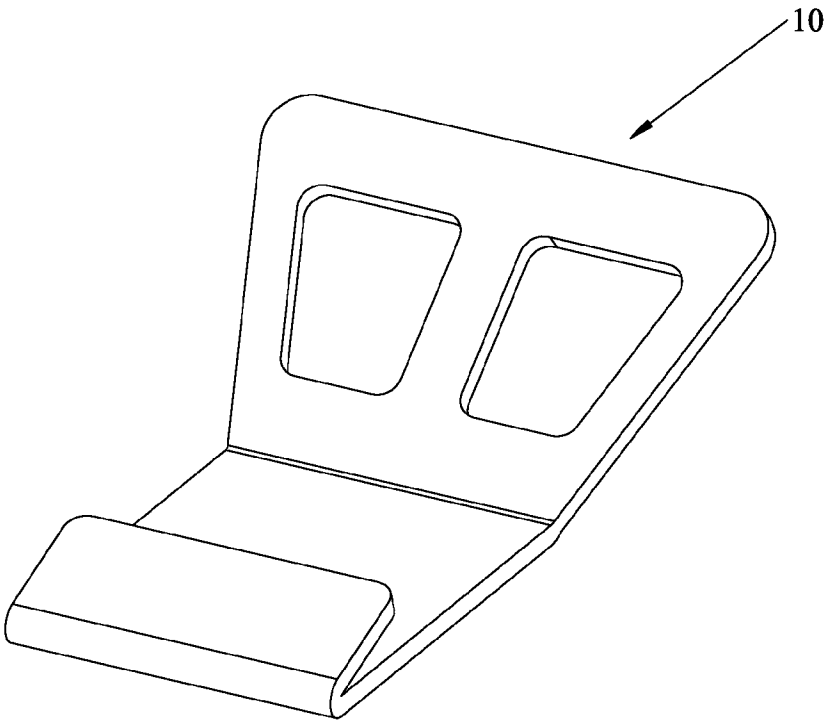
FIG. 1 is a front top right perspective view of the preferred embodiment of the rail rolling apparatus.
Figure 2:
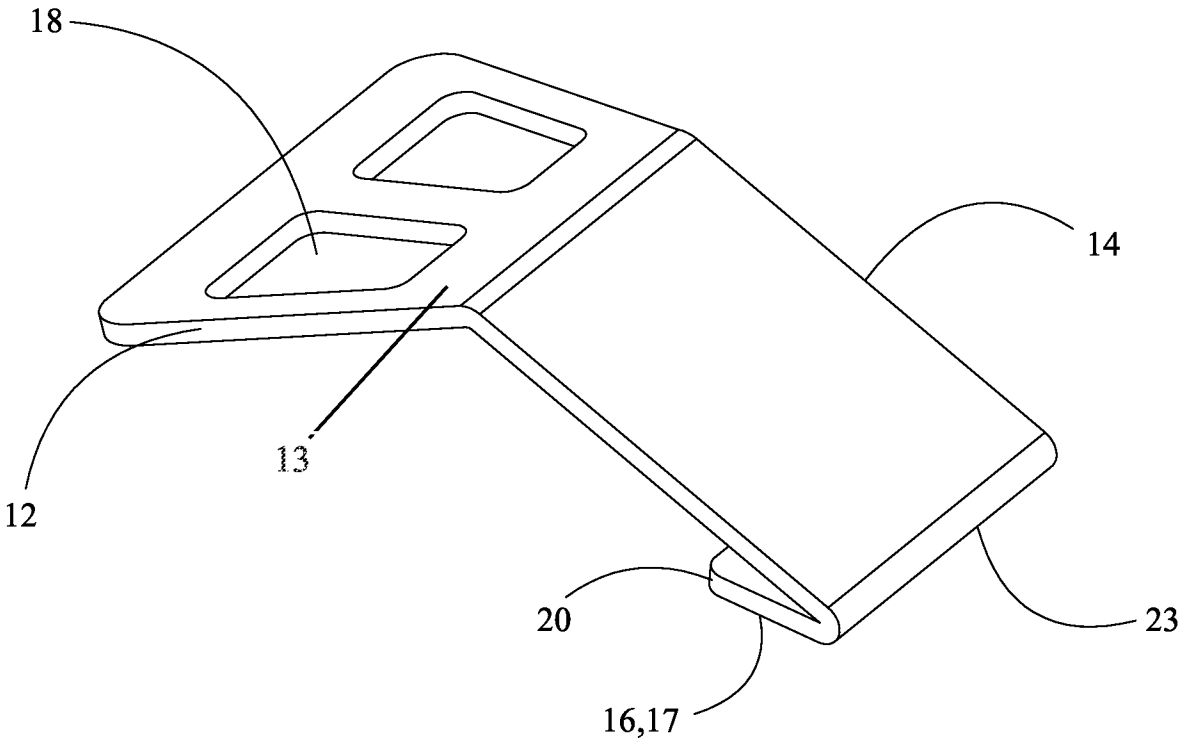
FIG. 2 is a front bottom right perspective view of the preferred embodiment of the rail rolling apparatus.
Figure 3:
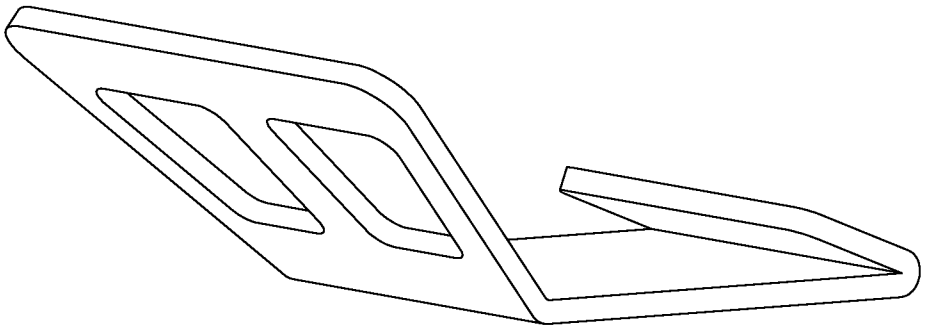
FIG. 3 is a back left side perspective view of the preferred embodiment of the rail rolling apparatus.
Figure 4:
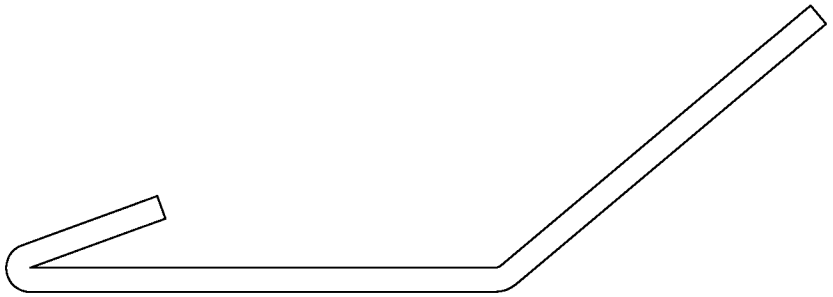
FIG. 4 is a right plan view of the preferred embodiment of the rail rolling apparatus.
Figure 5:
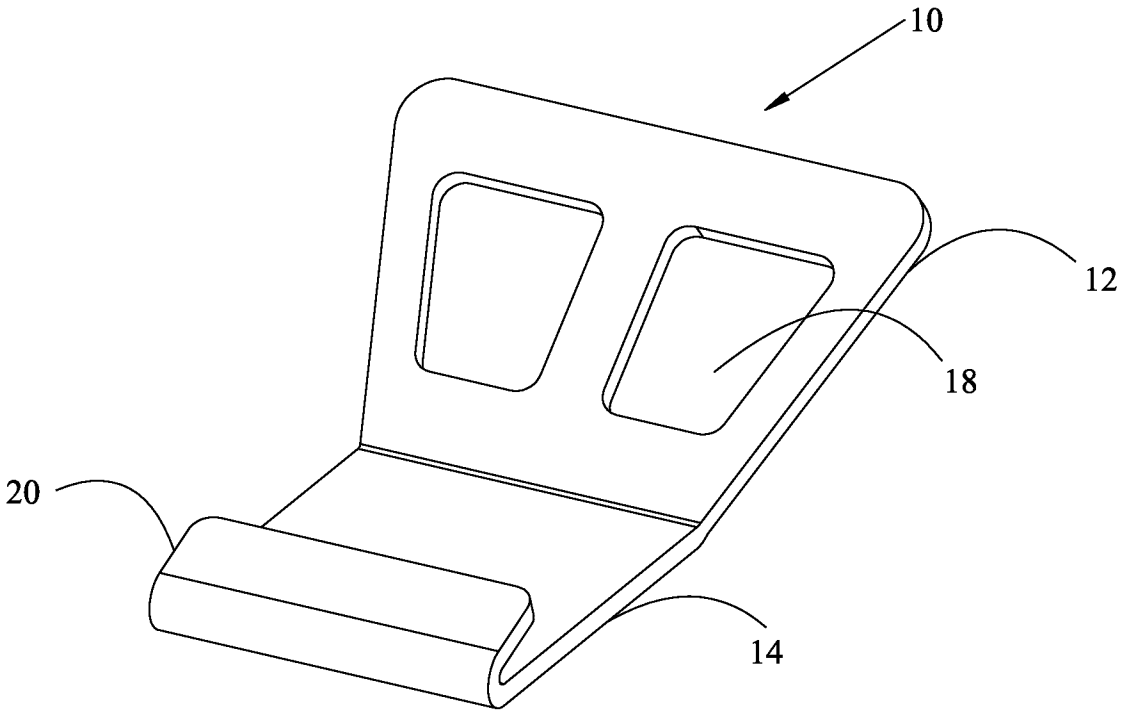
FIG. 5 is a front top right perspective view of the first alternate embodiment of the rail rolling apparatus.
Figure 6:
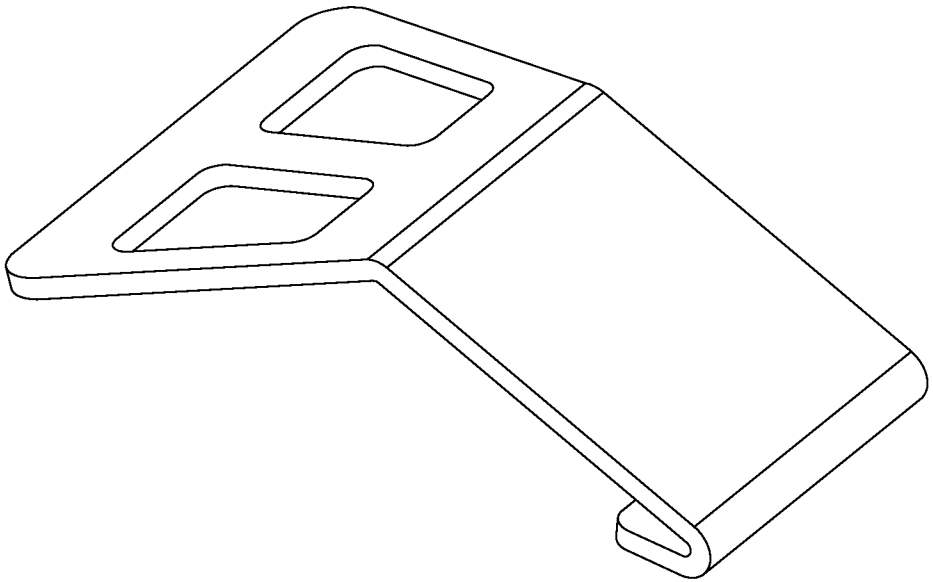
FIG. 6 is a right bottom perspective view of the first alternate embodiment of the rail rolling apparatus.
Figure 7:
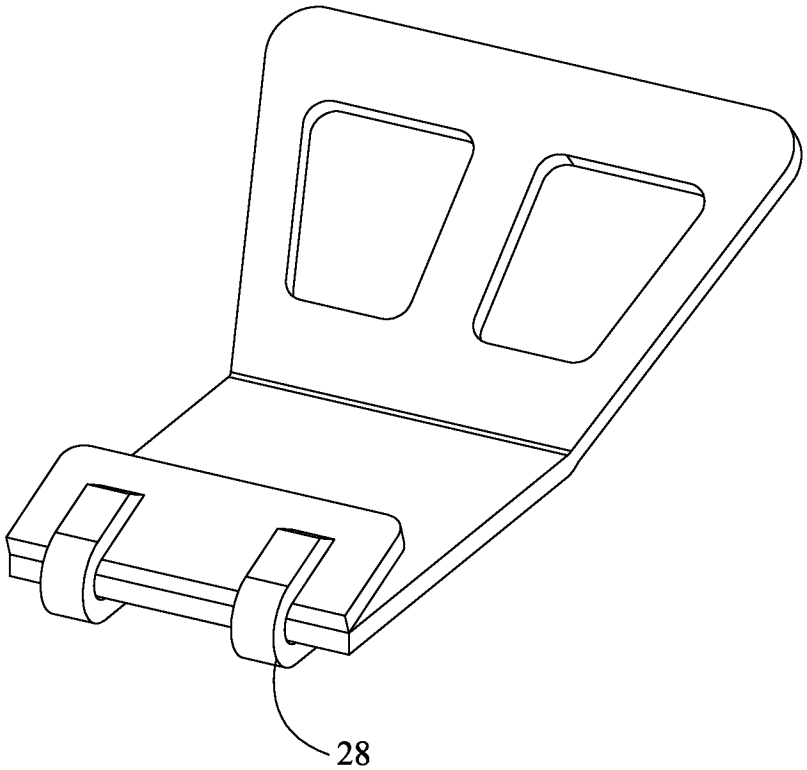
FIG. 7 is a front top right view of the second alternate embodiment of the rail rolling apparatus.
Figure 8:
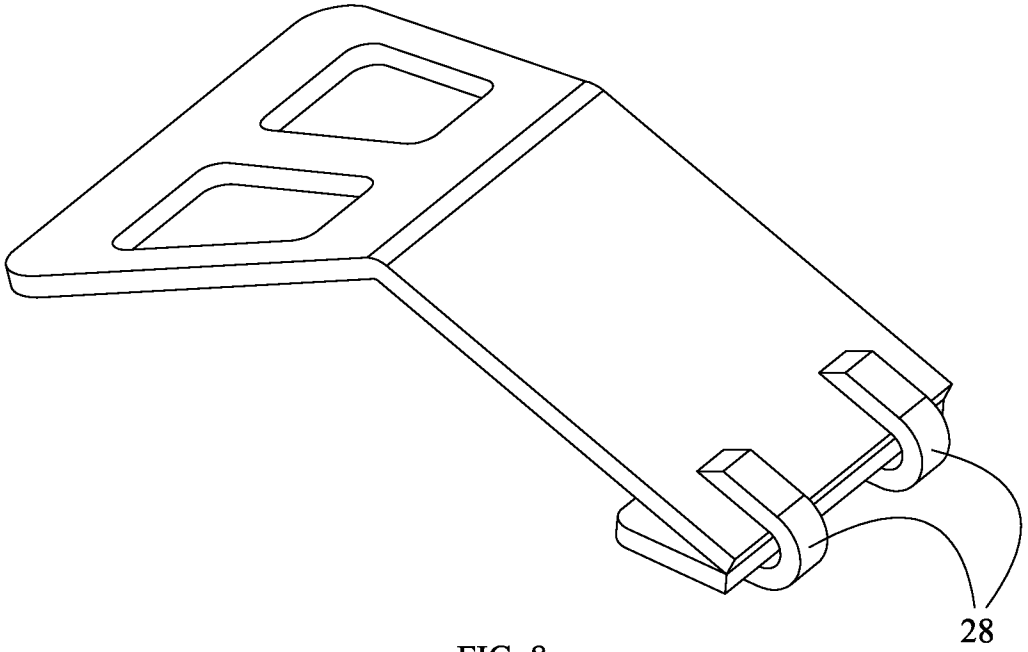
FIG. 8 is a right bottom perspective view of the second alternate embodiment of the rail rolling apparatus.
Figure 9:
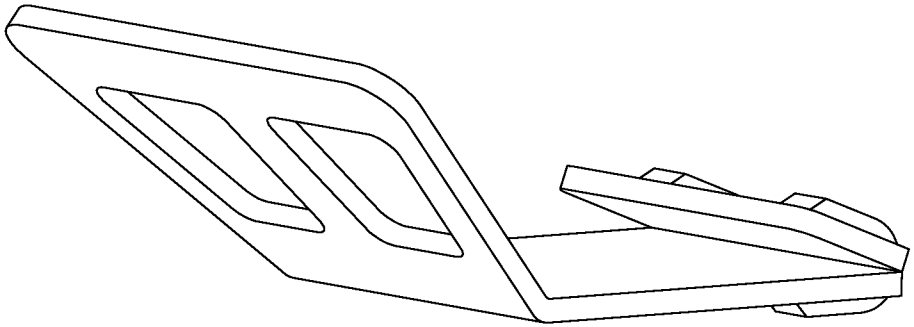
FIG. 9 is a left back perspective view of the second alternate embodiment of the rail rolling apparatus.
Figure 10:
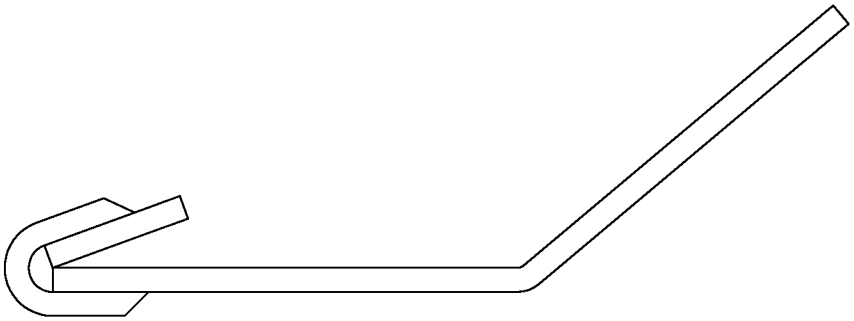
FIG. 10 is a right plan view of the second alternate embodiment of the rail rolling apparatus.
Figure 11:
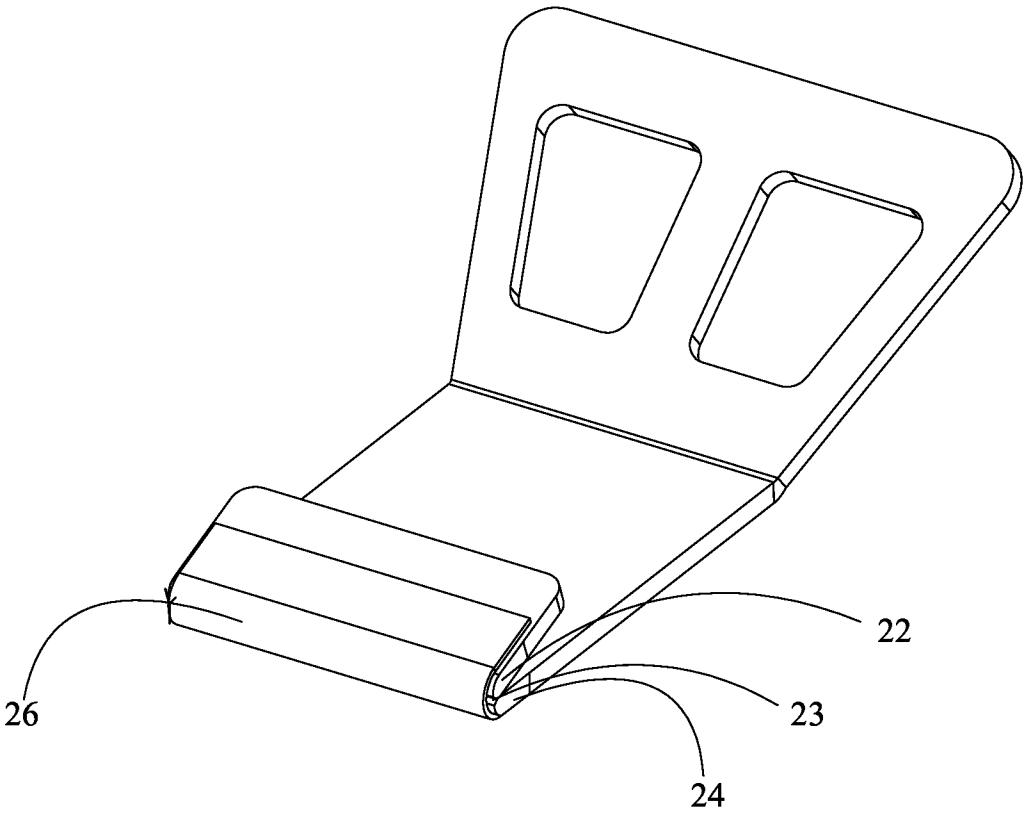
FIG. 11 is a front top right perspective view of the third alternate embodiment of the rail rolling apparatus.
Figure 12:
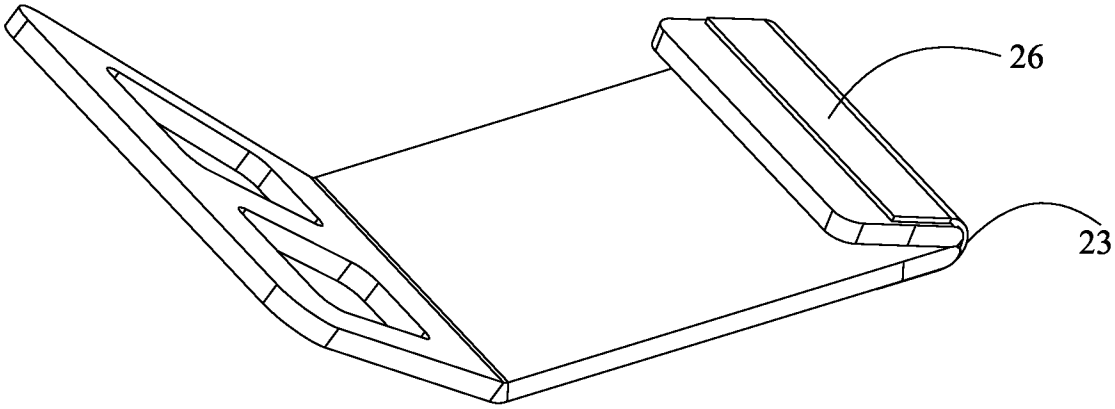
FIG. 12 is a left top perspective view of the third alternate embodiment of the rail rolling apparatus.
Figure 13:
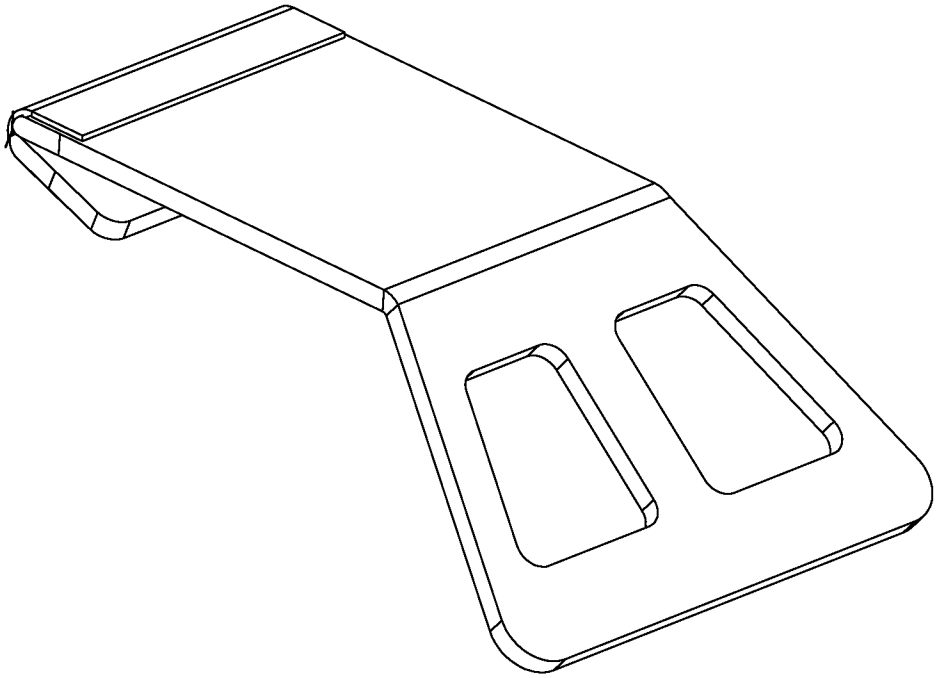
FIG. 13 is a rear bottom left perspective view of the third alternate embodiment of the rail rolling apparatus.
Figure 14:
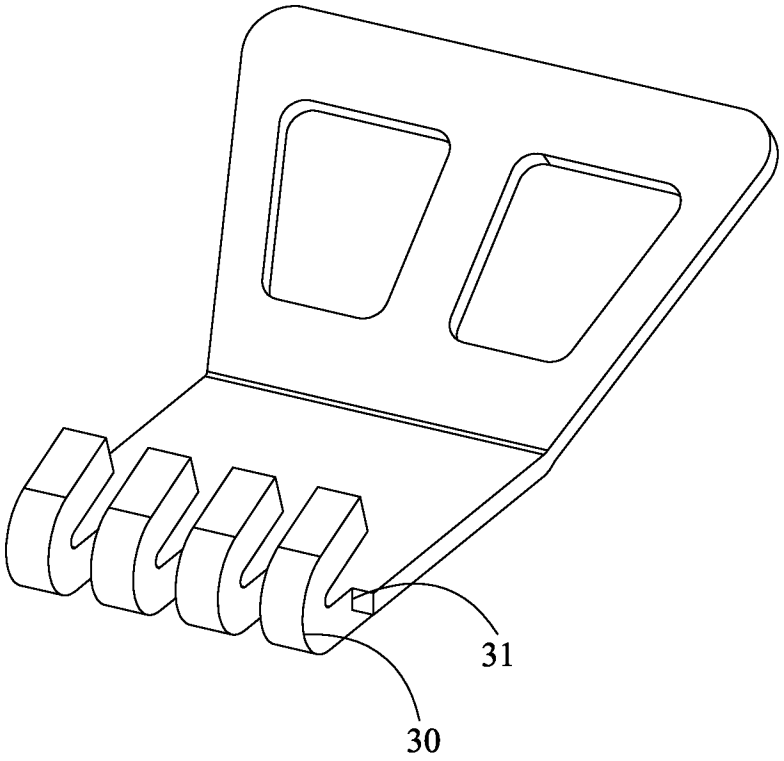
FIG. 14 is a front top right perspective view of the fourth alternate embodiment of the rail rolling apparatus.
Figure 15:
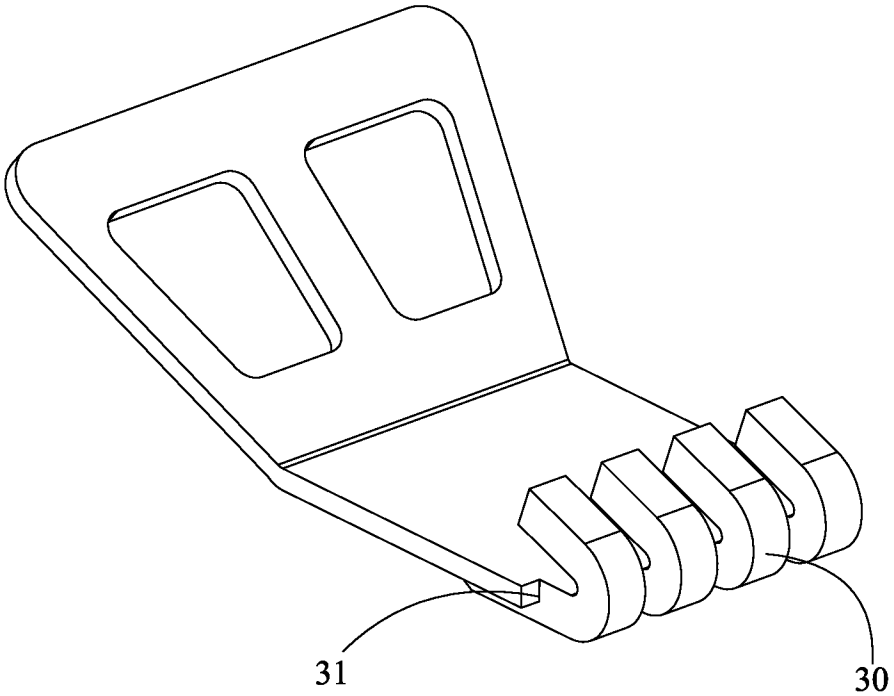
FIG. 15 is a front top left perspective view of the fourth alternate embodiment of the rail rolling apparatus.
Figure 16:
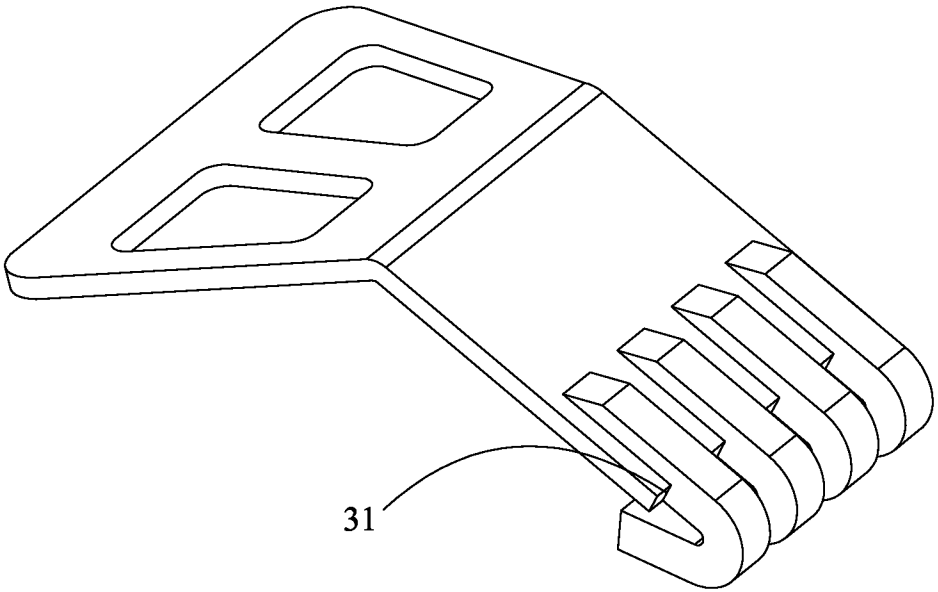
FIG. 16 is a right bottom perspective view of the fourth alternate embodiment of the rail rolling apparatus.
Figure 17:
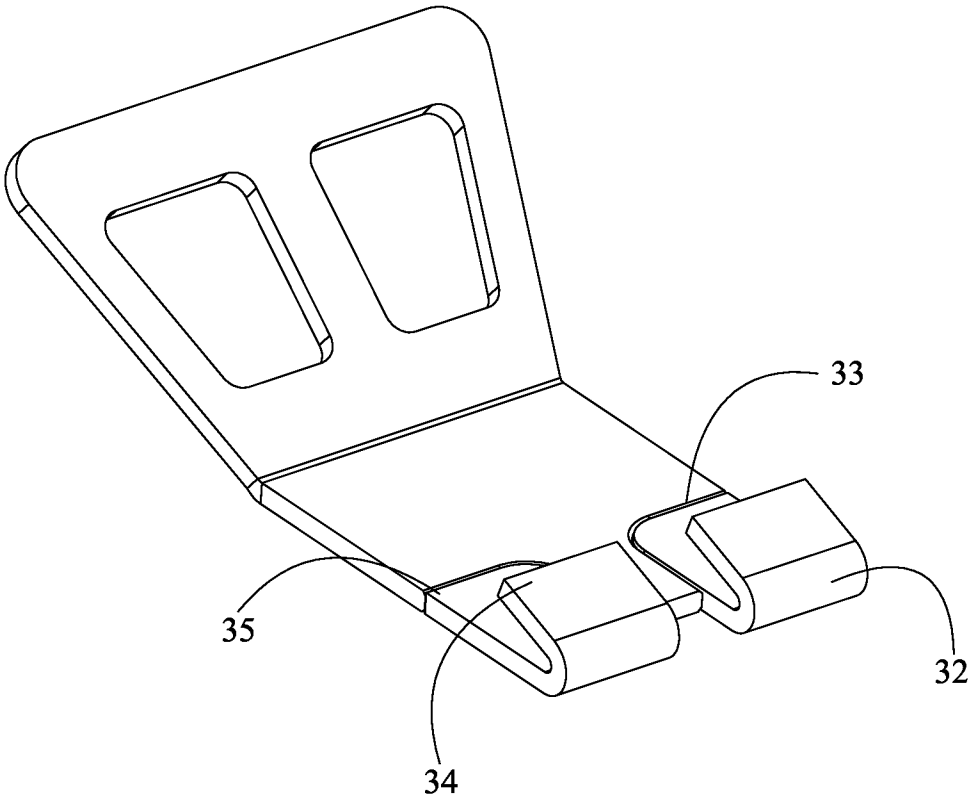
FIG. 17 is a front top left perspective view of the fifth alternate embodiment of the rail rolling apparatus.
Figure 18:
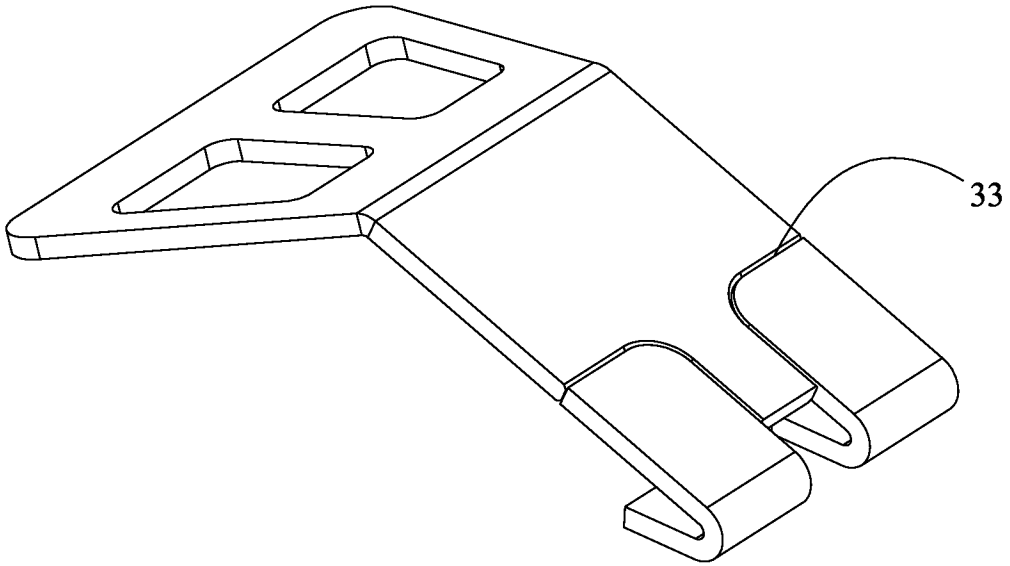
FIG. 18 is a right bottom perspective view of the fifth alternate embodiment of the rail rolling apparatus.
Figure 19:
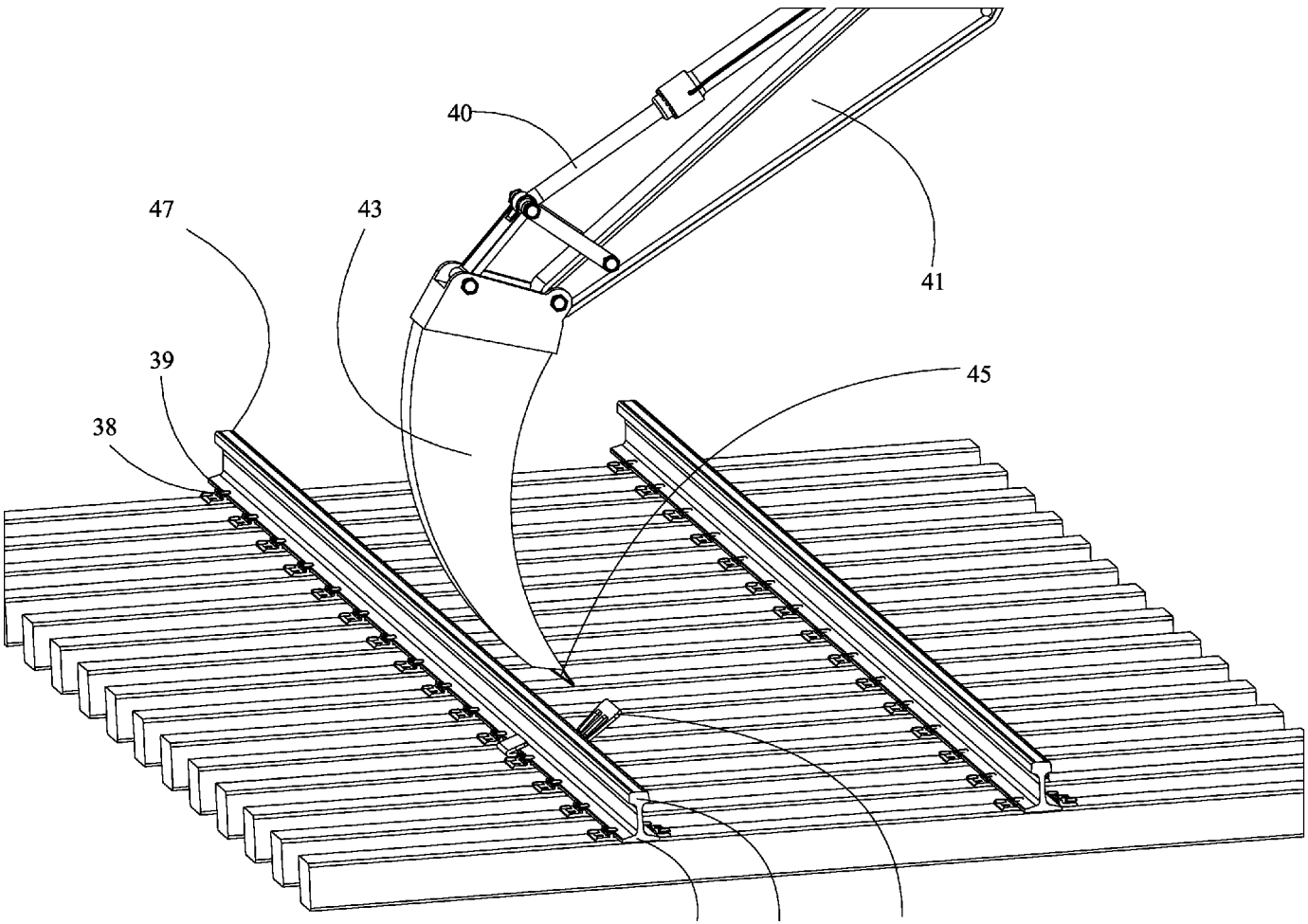
FIG. 19 is a perspective view of the method of use shown rolling track.
Figure 20:
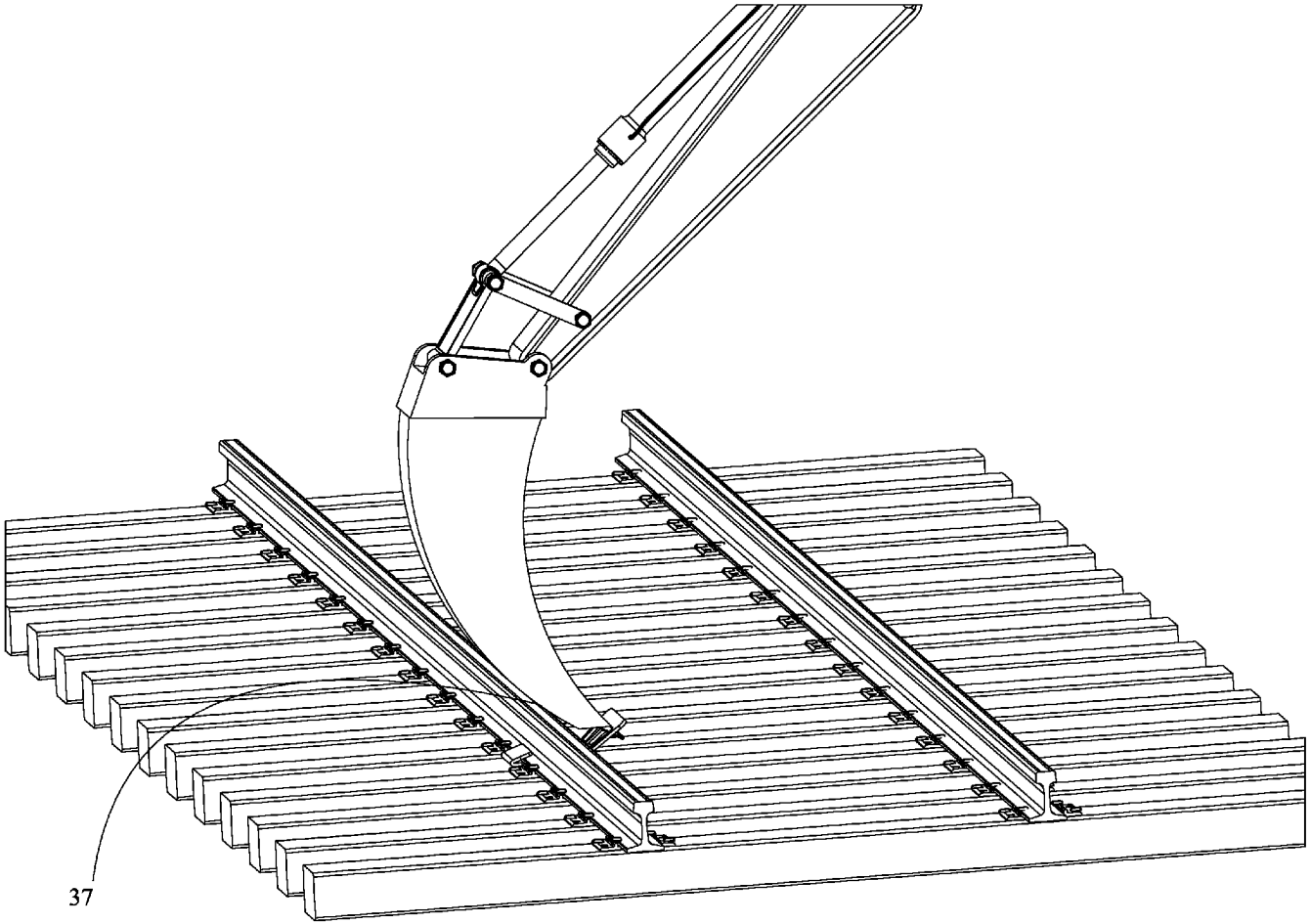
FIG. 20 is another perspective view of the method of use shown rolling track.
Figure 21:
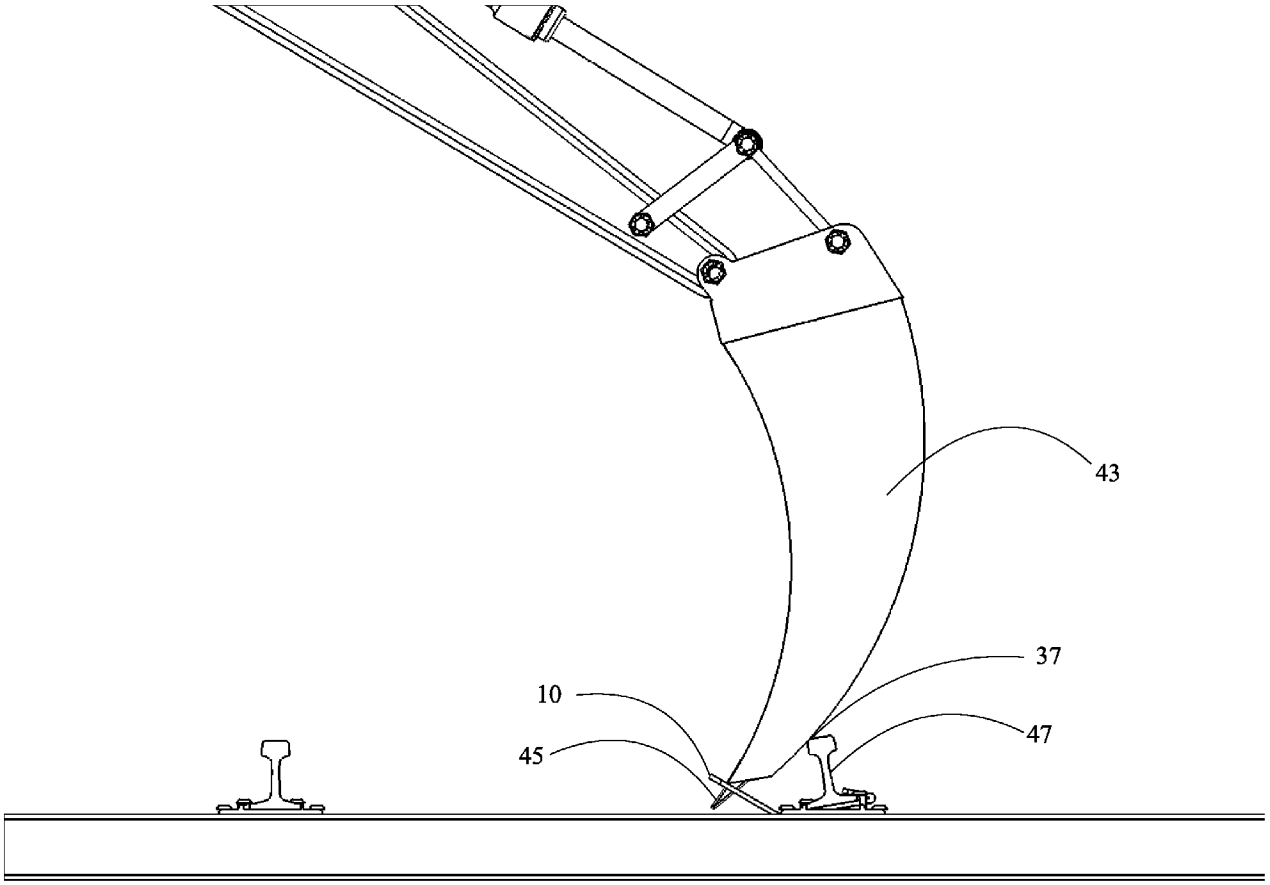
FIG. 21 is another perspective view of the method of use shown rolling track.
Figure 22:
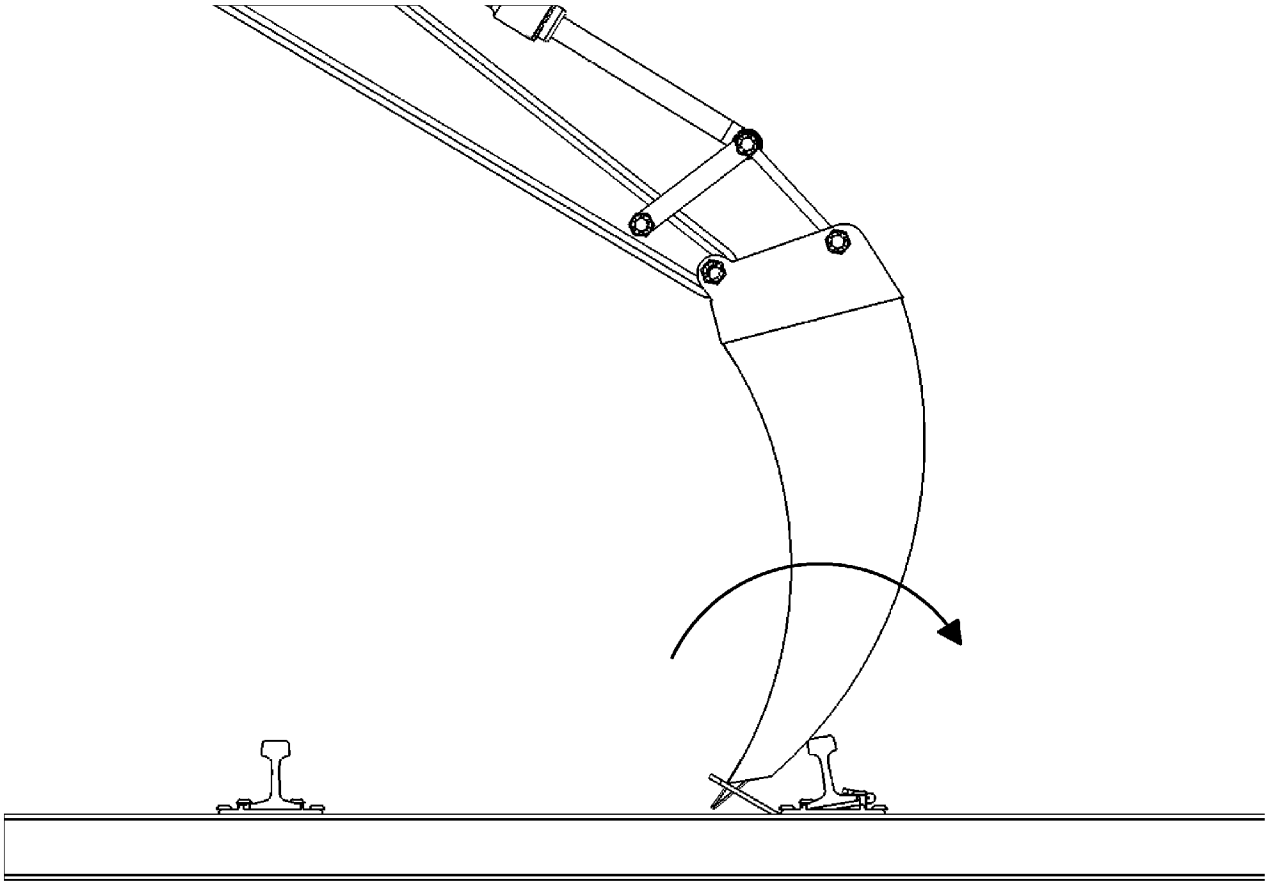
FIG. 22 is another perspective view of the method of use shown rolling track.
Figure 23:
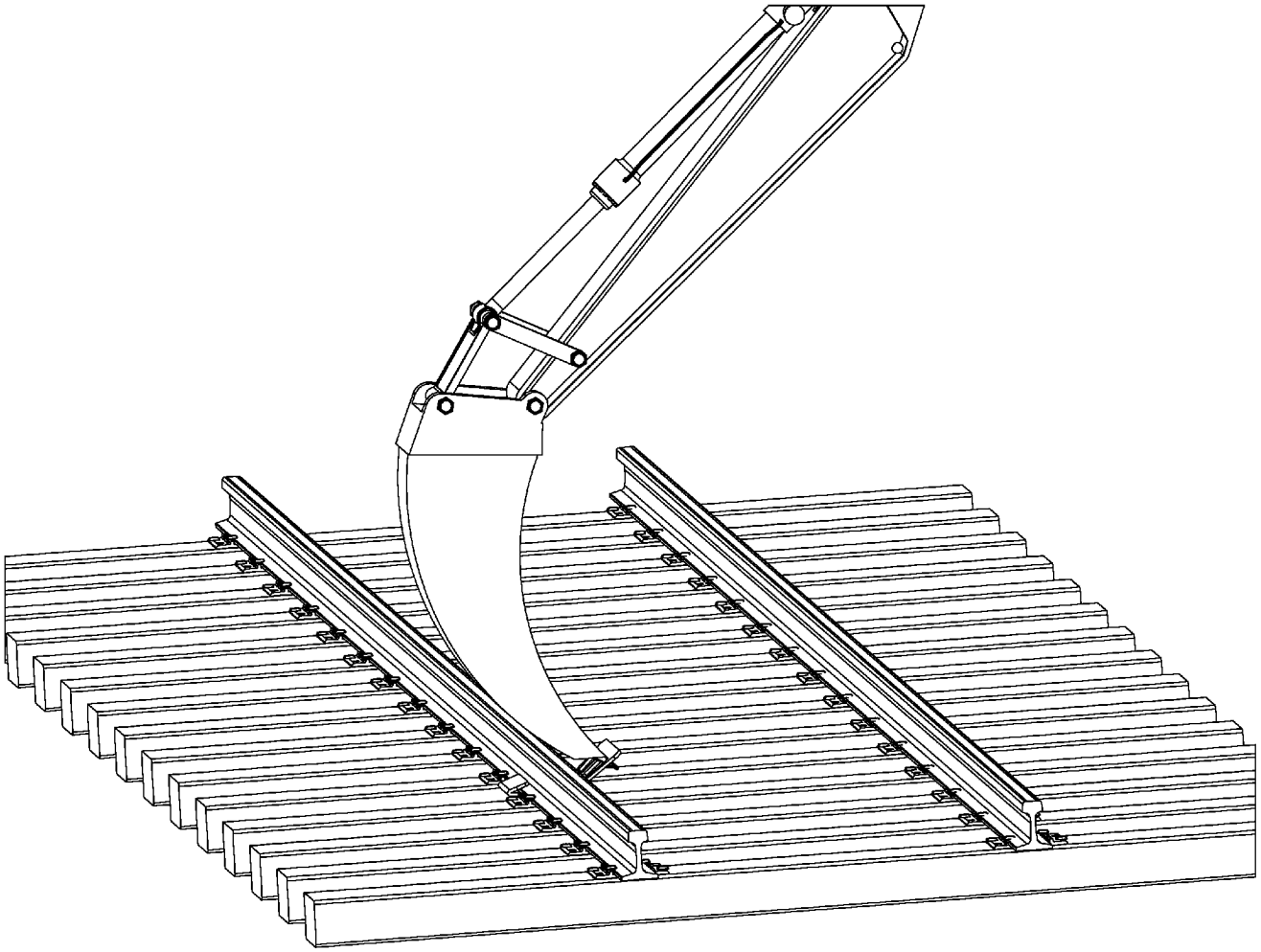
FIG. 23 is a perspective view of the method of use shown bending track.
Figure 24:
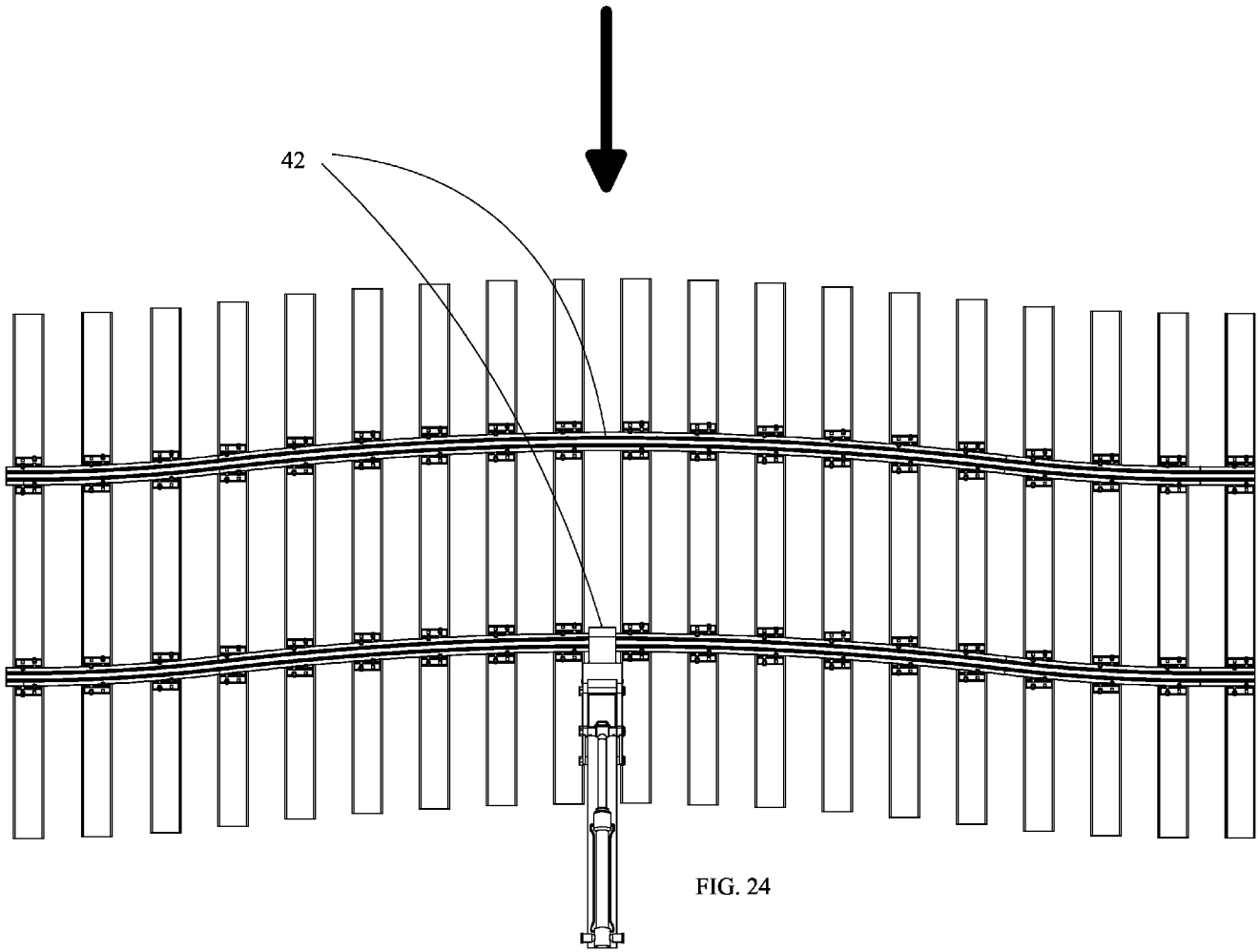
FIG. 24 is a perspective view of the method of use shown lining track.
Figure 25:
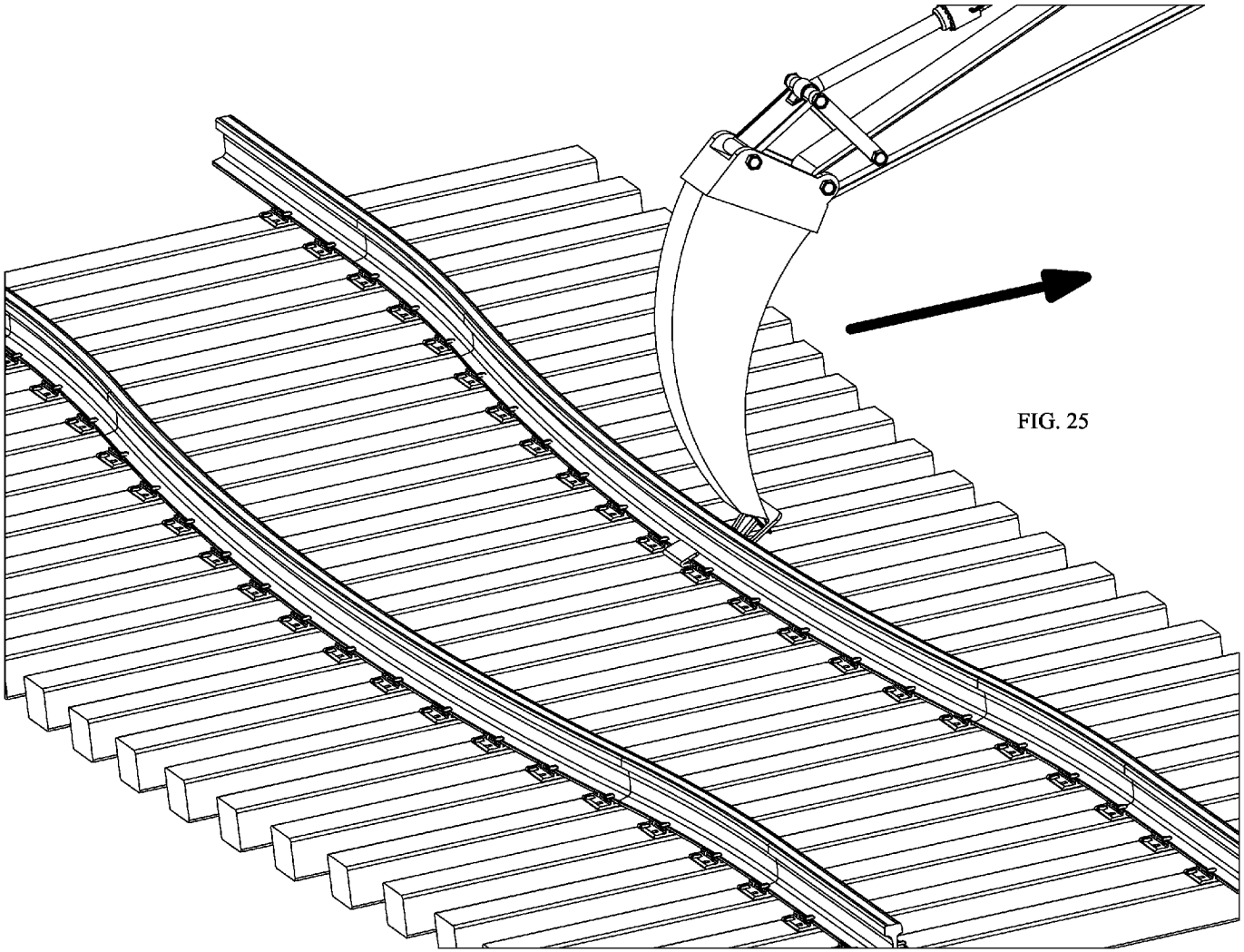
FIG. 25 is another perspective view of the method of use shown lining track.
Figure 26:
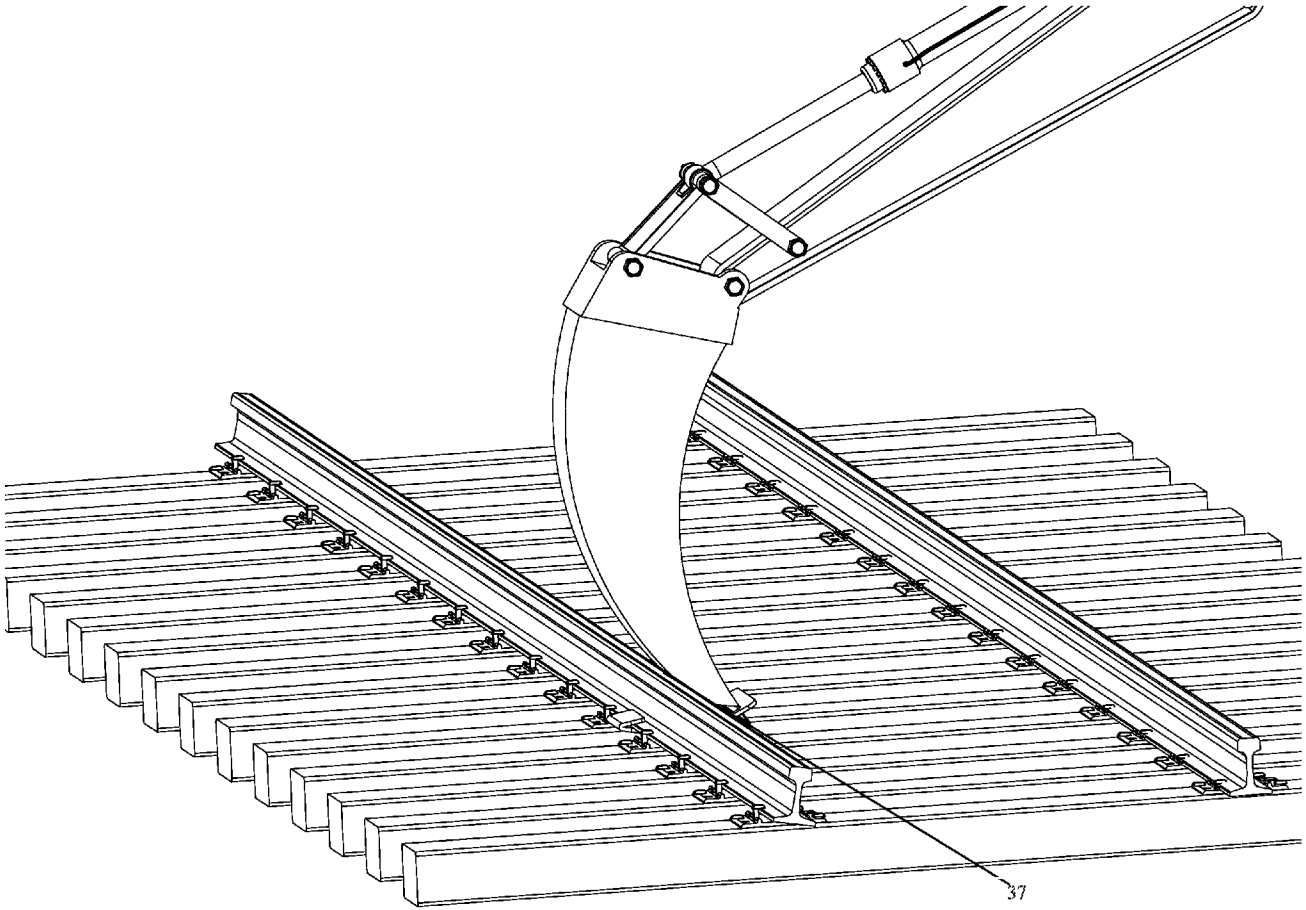
FIG. 26 is another perspective view of the method of use shown rolling track.

Referring now to the drawings, there is shown in FIGS. 1-4 a preferred embodiment of the rail rolling apparatus 10, in FIGS. 5-6 a first alternate embodiment of the rail rolling apparatus, in FIGS. 7-10 a second alternate embodiment of the rail rolling apparatus, in FIGS. 11-13 a third alternate embodiment of the rail rolling apparatus, in FIGS. 14-16 a fourth alternate embodiment of the rail rolling apparatus, in FIGS. 17-18 a fifth alternate embodiment of the rail rolling apparatus, and in FIGS. 19-25 the method of use of the apparatus 10. In accordance with the present invention, the preferred and alternate embodiments represent a rail rolling apparatus 10 and method of use in combination with traditional mechanized earth moving equipment utilizing hydraulic, electric, pneumatic, or mechanical attachments with one or more teeth or other protrusions 45. For example, a backhoe 40 with a cribbing bucket 43 attachment having one or more teeth 45, such as commonly used in the railroad service industry The present art rail rolling apparatus 10 generally comprises a back-end portion 12, a middle portion 14, and one or more hooks 20. Preferably, the one or more hooks 20 are elevated at an approximately 20 degree angle relative to the middle portion 14 and are capable of receiving a base portion 49 of a railroad track rail 47. Alternative hook 20 angles include any hook 20 angle that is capable of receiving the base portion 49 of the rail 47. The back-end portion 12 is preferably elevated at an approximate 40 degree angle relative to the middle portion 14 and further has one or more apertures 18 capable of receiving one or more teeth or protrusions 45 of a cribbing bucket 43 or other attachment utilized with a backhoe 40 or other mechanized equipment. Alternative back-end portion 12 angles include any angle that is capable of receiving a cribbing bucket 43 or other attachment. A front-end portion 16 in combination with the middle portion 14 forms the hook 20 portion which capable of receiving a base portion 49 of a railroad track rail 47.

In the preferred embodiment as shown in FIGS. 1-4, the one or more hooks 20 further comprise a front-end portion 16 which in combination with the middle portion 14 form the one or more hooks 20. The preferred embodiment of the rail rolling apparatus 10 is preferably made of two pieces of hot rolled plate steel, which after having the one or more apertures 18 cut into a first piece 13, is further cut to the desired dimensions. It is then fabricated by bending the back-end portion 12 at an approximate 40 degree angle in relation to the middle portion 14, and by attaching, preferably via welding 26, the second piece 17 as the front-end portion 16 so that it forms an approximate 20 degree angle in relation to the middle portion 14 such that the one or more hooks 20 are formed. Preferably the welds 26 are ground flush with the contours of the apparatus 10. The one or more hooks 20 have a substantially V-shaped cross-section which substantially conforms to the base angle of the rail 47 and as such is capable of receiving the base portion 49 of the rail 47.

In this preferred embodiment, the rail rolling apparatus 10 is constructed of hot rolled T1-A514 alloy steel, selected for its abrasion and impact resistance properties, and is approximately 0.5 inch thick. As the back-end portion 12 is bent or elevated at an approximate 40 degree angle in relation to the middle portion 14, when the rail rolling apparatus 10 is positioned on the ground under the rail 47, this 40 degree elevation of the back-end portion 12 in relation to the middle portion 14 allows a backhoe 40 to position the one or more teeth 45 of the cribbing bucket 43 within the one or more apertures 18 of the back-end portion 12. The back-end portion 12 of the rail rolling apparatus 10 is preferably substantially trapezoid-shaped thereby providing more surface area where the rail rolling apparatus 10 mates with or is attached to the cribbing bucket 43. The one or more apertures 18 are also substantially trapezoid-shaped in order conform to the shape of the back-end portion 12 and also to universally conform to the tooth profile of the cribbing (or other) buckets 43 typically utilized by railroad service crews. The one or more apertures 18 have approximately 4.50 inches between the parallel sides of the trapezoid. In this preferred embodiment the back-end portion 12 is approximately 12.00 inches wide at one end, approximately 8.00 inches wide at the other end, and approximately 8.50 inches long. Alternative preferred embodiments may utilize a plurality of back-end portion 12 elevation angles, shapes, apertures, and sizes without departing from the scope and spirit of the present art.

Also for the preferred embodiment, the middle portion 14 is substantially square-shaped and approximately 8.00 inches wide by approximately 10.00 inches long. The front-end portion 16 is substantially rectangular-shaped and is approximately 8.00 inches wide by approximately 2.50 inches long. The front-end portion 16 is elevated at an approximate 20 degree angle in relation the middle portion 14 such that the one or more hooks 20 formed by the front-end portion 16 in combination with the middle portion 14 substantially conforms to the base angle of the rail 47 and is capable of receiving the base portion 49 of the rail 47.

The material, size, shape, physical dimensions, and angles of the preferred and alternate embodiments of the rail rolling apparatus 10 as well as the disclosed method of manufacture and assembly can be changed or varied without departing from the scope and spirit of the present art invention.

In the first alternate embodiment as shown in FIGS. 5-6, the one or more hooks 20 further comprise a front-end portion 16 which in combination with the middle portion 14 form the one or more hooks 20. Preferably, the first alternate embodiment rail rolling apparatus 10 is made of a single piece of hot rolled plate steel, which after having the one or more apertures 18 cut, is further cut to the desired dimensions. It is then fabricated by bending the back-end portion 12 at an approximate 40 degree angle in relation to the middle portion 14, and by bending the front-end portion 16 over so that it forms an approximate 20 degree angle in relation to the middle portion 14 such that the one or more hooks 20 are formed. The one or more hooks 20 have a substantially V-shaped cross-section which substantially conforms to the base angle of the rail 47 and as such is capable of receiving the base portion 49 of the rail 47.

In this first alternate embodiment, the rail rolling apparatus 10 is constructed of hot rolled T1-A514 alloy steel, selected for its abrasion and impact resistance properties, approximately 0.5 inches thick. The back-end portion 12 is bent or elevated at an approximate 40 degree angle in relation to the middle portion 14. When the rail rolling apparatus 10 is positioned on the ground under the rail 47, this 40 degree elevation of the back-end portion 12 in relation to the middle portion 14 allows a backhoe 40 to position the one or more teeth 45 of the cribbing (or other) bucket 43 within the one or more apertures 18 of the back-end portion 12. The back-end portion 12 of the rail rolling apparatus 10 is substantially trapezoid-shaped thereby providing more surface area where the rail rolling apparatus 10 is attached to the cribbing bucket 43. The one or more apertures 18 are also substantially trapezoid-shaped in order conform to the shape of the back-end portion 12 and also to universally conform to the tooth profile of the cribbing buckets typically utilized by railroad service crews. The one or more apertures 18 have approximately 4.50 inches between the parallel sides of the trapezoid. In this preferred embodiment the back-end portion 12 is approximately 12.00 inches wide at one end, approximately 8.00 inches wide at the other end, and approximately 8.50 inches long.

Also in this first alternative embodiment, the middle portion 14 is substantially square-shaped and approximately 8.00 inches wide by approximately 10.00 inches long. The front-end portion 16 is substantially rectangular-shaped and is approximately 8.00 inches wide by approximately 2.50 inches long. The front-end portion 16 is elevated at an approximate 20 degree angle in relation the middle portion 14 such that the one or more hooks 20 formed by the front-end portion 16 in combination with the middle portion 14 substantially conforms to the base angle of the rail and is capable of receiving the base portion 49 of the rail 47.

The material, size, shape, physical dimensions, and angles of this first alternate embodiment of the rail rolling apparatus 10 as well as the disclosed method of manufacture and assembly can be changed or varied without departing from the scope and intent of the present invention.

In a second alternate embodiment of the present invention as shown in FIGS. 7-10, the rail rolling apparatus 10 further comprises one or more first gusset members 28 attached to and joining the middle portion 14 to the front-end portion 16. The front-end portion 16 and the middle portion 14 are attached together by the one or more gusset members 28 such that the front-end portion 16 is elevated approximately 20 degrees in relation to the middle portion 16 and thereby forms the one or more hooks 20 which substantially conform to the base angle of the rail 47 and is capable of receiving the base portion 49 of the rail 47.

The second alternate embodiment of the present invention is fabricated differently than in the first alternate embodiment. The front-end portion 16 is not formed by bending a single piece of steel but, as with the preferred embodiment, the front-end portion 16 of the rail rolling apparatus 10 is a separate piece which must be attached to the middle portion 14. The front-end portion 16 and the middle portion 14 are joined by the one or more gusset members 28 welded to the front-end portion 16 and the middle portion 14. The one or more gusset members 28 in addition to attaching the front-end portion 16 and the middle portion 14 together also provide increased strength and wear resistance. The front-end portion 16 and the middle portion 14 are attached together such that the front-end portion 16 is elevated approximately 20 degrees in relation to the middle portion 14 thereby forming the one or more hooks 20 which substantially conform to the base angle of the rail 47 and is capable of receiving the base portion 49 of the rail 47. The one or more gusset members 28 have a substantially U-shaped cross section and are preferably fabricated of hot rolled steel and approximately 1.0 inch wide and approximately 1.0 inch thick and are preferably welded equidistant across the width of the front-end portion 16 and the middle portion 14.

The material, size, shape, physical dimensions, and angles of this second alternate embodiment of the rail rolling apparatus 10 as well as the disclosed method of manufacture and assembly can be changed or varied without departing from the scope and intent of the present invention.

In a third alternate embodiment of the present invention, as shown in FIGS. 11-13, the rail rolling apparatus 10 further comprises a second gusset 26. In this third alternate embodiment, the rail rolling apparatus 10, is also fabricated slightly differently than in the preferred embodiment. Still, the one or more hooks 20 further comprise the front-end portion 16 in combination with the middle portion 14. Again, the front-end portion 16 is not formed by bending a single piece of steel but rather the front-end portion 16 of the rail rolling apparatus 10 is a separate piece which must be attached to the middle portion 14, preferably by welding. In order to accommodate a continuous weld bead or seam, both an end 22 of the front-end portion 16 and an end 24 of the middle portion 14 are chamfered and/or rounded and then welded or joined together. The front-end portion 16 and the middle portion 14 are welded or joined together such that the front-end portion 16 is elevated approximately 20 degrees in relation to the middle portion 16, thereby forming the one or more hooks 20 which substantially conform to the base angle of the rail 47 and is capable of receiving the base portion 49 of the rail 47.

In addition, the third alternate embodiment of the rail rolling apparatus 10 further comprises the second gusset 26 that is wrapped around at least some of the front-end portion 16 and at least some of the middle portion 14 thereby reinforcing the welded joint 23 and providing increased wear resistance. The gusset 26 is also preferably attached by welding it around the welded joint 23. The gusset 26 has a substantially U-shaped cross section and is preferably fabricated of steel. Also, the gusset 26 is substantially continuous in that it covers approximately the full width of the front-end portion 16, the middle portion 14, and the corresponding welded joint 23 attaching the two portions. In this third alternate embodiment, the gusset 26 has a thickness less than the thickness of the front-end portion 16 or the middle portion 14.

The material, size, shape, physical dimensions, and angles of this third alternate embodiment of the rail rolling apparatus 10 as well as the disclosed method of manufacture and assembly can be changed or varied without departing from the scope and intent of the present invention.

In a fourth alternate embodiment of the present invention as shown in FIGS. 14-16, the one or more hooks 20 further comprise a one or more J-shaped members 30 attached to the middle portion 14, but do not further comprise a front-end portion 16 as in the previous embodiments. Accordingly, the fourth alternate embodiment is also fabricated differently than the previously described preferred and alternate embodiments.

For the fourth alternate embodiment, the one or more J-shaped members 30 have a substantially J-shaped cross section with an approximate 20 degree bend such that when the one or more J-shaped members 30 are attached to the middle portion 14 they are elevated approximately 20 degrees in relation to the middle portion 14, as in the previous embodiments. The approximate 20 degree angle of the one or more J-shaped members 30 substantially conforms to the base angle of the rail 47 and as such the one or more J-shaped members 30 forms the one or more hooks 20 of the fourth alternate embodiment of the rail rolling apparatus 10. The one or more hooks 20 are capable of receiving the base portion 49 of the rail 47. Said J-shaped members 30 are preferably fabricated of hot rolled steel and are approximately 1.0 inch wide, approximately 3.5 inches long, and approximately 1.0 inch thick. The members 30 are preferably attached equidistant across the width of the middle portion 14. In this fourth alternate embodiment, the one or more J-shaped members 30 have a thickness approximately twice the thickness of the middle portion 14. The one or more J-shaped members 30 preferably have an approximate 0.5" recess or shoulder 31 capable of receiving the approximate 0.5" thick middle portion 14 such that the middle portion 14 and the one or more J-shaped hooks 30 can be welded together along this shoulder 31. The shoulder 31 providing more surface area for welding and also a somewhat slimmer profile.

The material, size, shape, physical dimensions, and angles of this fourth alternate embodiment of the rail rolling apparatus 10 as well as the disclosed method of manufacture and assembly can be changed or varied without departing from the scope and intent of the present invention.

In a fifth alternate embodiment of the present invention as shown in FIGS. 17-18, the one or more hooks 20 further comprise a plurality of hook members 32 attached to the middle portion 14, but do not further comprise a front-end portion 16 as in some of the previous embodiments. The plurality of hook members 32 having a top portion 34 and a bottom portion or base 35. As such, the fifth alternate embodiment is also fabricated differently than the previously described preferred and alternate embodiments.

In this fifth alternate embodiment of the present invention, the middle portion 14 further comprises one or more recesses or cutouts 33 which provide increased surface area for welding or attaching the plurality of hook members 32. The base 35 of the plurality of hook members 32 is shaped such that when welded or attached to the middle portion 43 at and adjacent to the one or more recesses or cutouts 33, it substantially matches the shape of the middle portion 43. The top portion 34 of the plurality of hook members 32 forming an approximate 20 degree angle in relation to the base 35 such that when the base 35 is welded to the middle portion 14, the plurality of hook members 32 are elevated approximately 20 degrees in relation to the middle portion 14. As such, the one or more hooks 20 of this fifth alternate embodiment substantially conforms to the base angle of the rail 47 and is therefore capable of receiving the base portion 49 of the rail 47, as in the previous embodiments. The plurality of hook members 32 are preferably fabricated of hot rolled steel and approximately 3.0 inches wide, approximately 3.0 inches long and approximately 0.5 inches thick which is approximately the same thickness as the middle portion 14 thereby affording a substantially flush fit.

The material, size, shape, physical dimensions, and angles of this fifth alternate embodiment of the rail rolling apparatus 10 as well as the disclosed method of manufacture and assembly can be changed or varied without departing from the scope and intent of the present invention.

The method of use is shown in FIGS. 19-25. During use, the preferred and alternate embodiments of the rail rolling apparatus 10, are all utilized in substantially the same way. In order to repair or fix a rolled-over rail, for example, an area is dug out under the rail 47 and then the rail rolling apparatus 10 is positioned under the rail 47. Next, the one or more hooks 20 are placed over the base portion 49 of the rail 47. The Figures show the hook 20 of the preferred embodiment attached to the base portion 49 of the rail 47. In a rolled-over rail situation, the one or more hooks 20 are first attached to the base portion 49 on the rail 47 on the high side of the rolled-over rail 47. The backhoe 40 then places the one or more teeth 45 of the cribbing bucket 43 into the one or more apertures 18 from the top and tilts or rolls the cribbing bucket 43 towards the backhoe 40 and away from the rail 47. This tilting or rolling motion of the cribbing bucket 43 causes a portion of the cribbing bucket 43 to contact the top or head 36 of the rail, thereby 47 creating a fulcrum or pivot point 37. Further rolling or tilting of the cribbing bucket 43 allows the rolled-over rail 47 to be rolled back down into the one or more plates 38 where it can be re-attached with one or more spikes 39.

The rail rolling apparatus 10 can also be utilized to roll bent rail 47 utilizing the steps listed above with the additional step of pushing or pulling on the rail 47 with the backhoe 40, depending on how it is bent. That is, the cribbing bucket 43 is rolled or tilted such that a portion of the cribbing bucket touches the top or head 36 of the rail 47 and creates a fulcrum or pivot point 37. The rail is now essentially locked or pinched between the cribbing bucket 43 contacting the top or head 36 of the rail 47 and the one or more hooks 20 contacting the foot or base portion 49 of the rail 47. Again, the one or more hooks 20 are attached to the base portion 49 of the rail 47 on the high side of the rail 47. After the rolling or tilting of the cribbing bucket 43 has locked the rail 47, the arm 41 of the backhoe 40 can push or pull on the rail 47. If the rail 47 is bent towards the backhoe 40, the backhoe 40 pushes via its arm 41 on the rail 47. If the rail 47 is bent away from the backhoe 40, the backhoe 40 pulls via its arm 41 on the rail 47.

Once the rail is locked into the pivot point 37 with the one or more hooks 20 and the cribbing bucket 43, either (a) further rolling or tilting movement of the cribbing bucket 43 allows the rail 47 to be rolled back down into the one or more plates 38 where it can be re-attached with the one or more spikes 39; and/or (b) further movement of the backhoe arm 41, either forward/pushing or rearward/pulling, causes the bent rail 47 to substantially straighten such that it can be realigned back into the one or more plates 38 and re-attached with the one or more spikes 39.

The rail rolling apparatus 10 can also be used to line track without touching the rail 47 with the cribbing bucket 43 simply by hooking it onto a piece of rail 47 at a balance point 42 (i.e. substantially center portion of a length of track) and then sliding the rail 47 back and forth. In operation, the one or more hooks 20 of the rail rolling apparatus 10 are placed over the base portion 49 of the rail 47 at an approximate balance point 42 which is approximately determined relative to the length of the rail 47. Next, the backhoe 40 places the one or more teeth 45 of the cribbing bucket 43 into the one or more apertures 18 of the back end portion 12. The one or more teeth 45 enter the one or more apertures 18 from the top, then the backhoe 40 tilts or rolls the cribbing bucket 43 towards the backhoe 40 and away from the rail 47 but just enough to lift, support, and/or balance the rail 47 without contacting the top or head 36 of the rail 47. The rail 47 is then slid back and forth by pivoting the backhoe arm 41 in either a clockwise or counter-clockwise direction. The track lining is accomplished with the rail rolling device 10 of the present invention without ever having to create a pinch or pivot point between the cribbing bucket 43 and the top or base portion 49 of the rail 47 thereby eliminating a potential damage source.

Although described for enablement purposes, the lengths, widths, and other dimensional attributes may depart significantly from those specified. The shape, size, location, component numbers, and mounting methods utilized for each of the components or constituent elements may take a plurality of forms as recognized within the pertinent arts without departing from the scope and spirit of the present invention.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A method of rolling, repositioning, or setting a railroad rail, the steps comprising:

forming a rail rolling apparatus having a back end portion, a middle portion, and one or more hooks substantially opposite said back end portion; and attaching said back end portion and said hooks with said middle portion whereby said middle portion is between said back end portion and said hooks; and forming one or more apertures of a size capable of accepting one or more teeth from a bucket of a backhoe within said back end portion; and forming said one or more hooks into a substantially "V" or "U" shaped cross section capable of receiving a base portion of a railroad rail; and placing said middle portion under a railroad rail; and receiving a foot or base portion of the railroad rail with said substantially "V" or "U" shaped cross section hooks; and placing said hooks over a portion of the base portion of the railroad rail; and placing one or more teeth of the bucket into said one or more apertures; and moving the bucket thereby rolling, repositioning, or setting the railroad rail.

2. The method of rolling, repositioning, or setting a railroad rail as set forth in claim 1, the steps further comprising:

receiving the foot or base portion of a high side of the railroad rail when the railroad rail is rolled over; and tilting or rolling the bucket towards the backhoe and away from the railroad rail; and contacting a top or a head of the railroad rail with a portion of the bucket and thereby creating a fulcrum or pivot point; and further tilting or rolling the bucket thereby rolling the rolled over rail into a non-rolled over position.

3. The method of rolling, repositioning, or setting a railroad rail as set forth in claim 1, the steps further comprising:

receiving the foot or base portion of the railroad rail having a bend; and tilting or rolling the bucket towards the backhoe and away from the railroad rail; and contacting a top or a head of the railroad rail with a portion of the bucket and thereby creating a fulcrum or pivot point; and locking or pinching the bucket between the top or head of the rail and the one or more hooks contacting the foot or base portion of the rail; and pushing or pulling the rail via a pushing or a pulling of an arm of the backhoe thereby substantially forming a straightening or a realigning of the rail.

4. The method of rolling, repositioning, or setting a railroad rail as set forth in claim 1, the steps further comprising:

receiving the foot or base portion of the railroad rail for a track lining; and positioning the rail rolling apparatus at an approximate balance point for the railroad rail; and tilting or rolling the bucket toward the backhoe and away from the railroad rail in order to lift, support, and/or balance the railroad rail; and pivoting an arm of the backhoe in a clockwise or counter-clockwise direction; and sliding the railroad rail via said pivoting into a desired position whereby said track lining is accomplished.

* * * * *